US011067097B2

(12) United States Patent
Göller et al.

(10) Patent No.: US 11,067,097 B2
(45) Date of Patent: Jul. 20, 2021

(54) VENTILATOR AND METHOD FOR MOUNTING A VENTILATOR

(71) Applicant: ZIEHL-ABEGG SE, Künzelsau (DE)

(72) Inventors: Matthias Göller, Weißbach (DE); Lothar Ernemann, Heilbronn (DE)

(73) Assignee: ZIEHL-ABEGG SE, Künzelsau (DE)

( * ) Notice: Subject to any disclaimer, the term of this patent is extended or adjusted under 35 U.S.C. 154(b) by 119 days.

(21) Appl. No.: 16/273,888

(22) Filed: Feb. 12, 2019

(65) Prior Publication Data

US 2019/0257322 A1 Aug. 22, 2019

(30) Foreign Application Priority Data

Feb. 19, 2018 (DE) ..... 102018202487.1

(51) Int. Cl.

| | |
|---|---|
| ***F04D 29/62*** | (2006.01) |
| ***F04D 29/42*** | (2006.01) |
| ***F04D 29/64*** | (2006.01) |
| ***F04D 19/00*** | (2006.01) |

(52) U.S. Cl.

CPC ..... *F04D 29/626* (2013.01); *F04D 19/002* (2013.01); *F04D 29/4226* (2013.01); *F04D 29/644* (2013.01); *F05D 2250/50* (2013.01)

(58) Field of Classification Search

CPC .. F04D 29/626; F04D 29/4226; F04D 19/002; F04D 29/644; F04D 29/281; F04D 29/263; F04D 25/08; F04D 29/601

USPC ..... 415/191

See application file for complete search history.

(56) References Cited

U.S. PATENT DOCUMENTS

| | | | | |
|---|---|---|---|---|
| 4,767,285 | A * | 8/1988 | Jyoraku | F04D 25/06 417/366 |
| 5,407,324 | A * | 4/1995 | Starnes, Jr. | F04D 29/542 29/888.025 |
| 5,788,566 | A * | 8/1998 | McAnally | H05K 7/20172 361/695 |
| 6,000,919 | A * | 12/1999 | Hsieh | F04D 29/646 415/220 |
| 6,224,335 | B1 * | 5/2001 | Parisi | F04D 29/162 415/206 |
| 8,992,175 | B2 * | 3/2015 | Heli | F04D 29/624 415/209.3 |
| 2010/0329857 | A1 * | 12/2010 | Heli | F04D 25/0613 415/182.1 |
| 2012/0020778 | A1 * | 1/2012 | Ruck | F04D 17/06 415/208.1 |

(Continued)

FOREIGN PATENT DOCUMENTS

| | | |
|---|---|---|
| DE | 4127134 | 2/1993 |
| DE | 202010013785 | 2/2011 |

(Continued)

*Primary Examiner* — J. Todd Newton

(74) *Attorney, Agent, or Firm* — Jason P. Mueller; FisherBroyles, LLP

(57) ABSTRACT

Disclosed is a ventilator with an electrical drive and at least one rotating or non-rotating functional unit associated with the drive or with a structural component of the drive for generating and/or influencing an air current, wherein the functional unit is arranged coaxially around the drive or in front of it or after it, and wherein the association takes place directly or indirectly in a positive and non-positive manner by the intermeshing and mutual bracing of connection means.

12 Claims, 8 Drawing Sheets

(56) References Cited

U.S. PATENT DOCUMENTS

Figure 1:
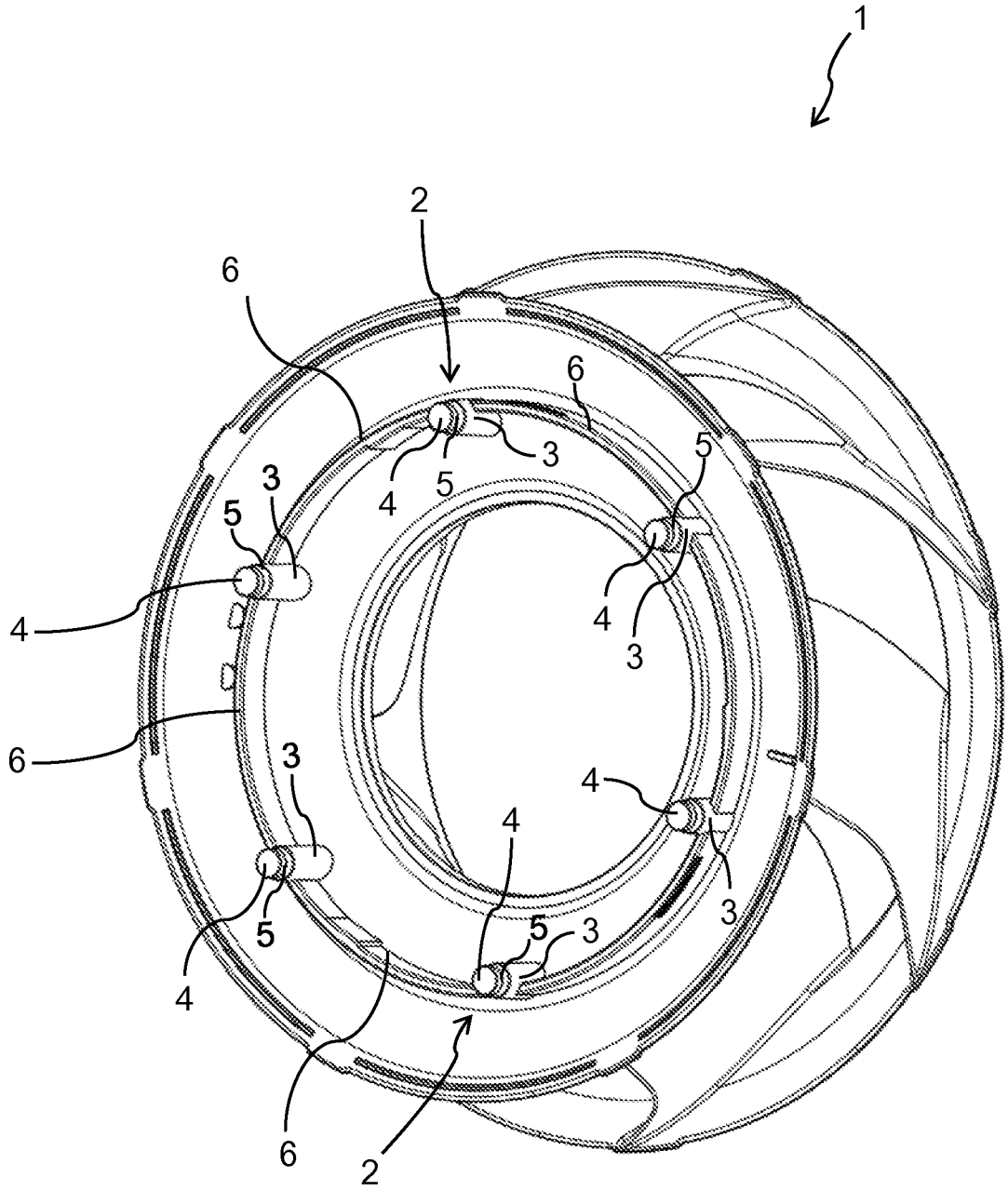

2019/0154042 A1* 5/2019 Chang ..... F04D 25/08

FOREIGN PATENT DOCUMENTS

| | | |
|---|---|---|
| DE | 102014215817 | 2/2016 |
| DE | 102014226288 | 6/2016 |
| DE | 102015207800 | 11/2016 |
| EP | 2792885 | 10/2014 |

* cited by examiner

VENTILATOR AND METHOD FOR MOUNTING A VENTILATOR

This Application claims priority to German patent application No. 10 2018 202 487.1, filed Feb. 19, 2018, the entire contents of which is incorporated herein by reference. The disclosure relates to a ventilator with an electrical drive and at least one rotating or non-rotating functional unit associated with the drive or with a structural component of the drive for generating and/or influencing an air current. Furthermore, the disclosure relates to a method for mounting a ventilator.

The ventilator concerned here can be any ventilator with an electrical drive, for example an axial, radial or diagonal ventilator. Such ventilators are sufficiently known from the practice. EP 2 792 885 A1 is cited solely by way of example, wherein, in addition to the impeller serving to generate the air current on the air exit side, a bladed post-guidance impeller is provided which should improve the circulation of air. The impeller as well as the post-guidance impeller are to be attached to the drive or to its housing with or without the interpositioning of an adapter flange.

DE 10 2015 207 800 A1 shows a diagonal ventilator or radial ventilator with a guidance device, wherein the development of noise should be reduced and the air output and the degree of efficiency should be increased.

In the prior art, especially in the case of the ventilators known from the practice, the mounting of the structural components is expensive and therefore problematic. In particular in the connection of radial impellers or diagonal impellers to the electrical drive or the drive unit, a screw connection with about six screws is regularly realized which are either screwed into areas of the drive unit or into the impeller. The screwing of the parts represents a significant mounting expense and entails, as regards the screws, material costs which are not unnecessary. The same applies to the attaching of other functional units, for example, a front guidance grid, a post-guidance impeller, a diffuser, etc. The mounting expense for the screwing of the functional units is always complicated and therefore cost-intensive.

In light of the above explanations, embodiments of the disclosure may eliminate the problems occurring in the prior art, in particular may at least minimize the expenses for mounting and material which occur with the connecting of the functional parts.

Furthermore, a method for mounting such a ventilator should be indicated which meets the above requirements.

The above task is solved regarding the ventilator by the features of the claims, namely in that the functional unit, in the simplest case a fan wheel or impeller coaxially arranged around the drive or in front of it or after it (as regards the direction of the air flow) is associated directly or indirectly with the electrical drive, namely by a positive and non-positive intermeshing and a mutual bracing of connection means. Therefore, the connection takes place without screws.

It is noted at this point that the quite general connection of any functional units to the electrical drive of a ventilator is concerned here, wherein the electrical drive is to be understood in its broadest sense. This also includes the housing of the electrical drive and holding devices connected to it or provided in the surroundings of the electrical drive to which various functional units may be fastened.

It became known according to the disclosure that the active connection between the electrical drive of a ventilator and, for example, an impeller may be produced without screws, namely, in that special connection means which is associated with the drive and the particular functional unit are positively and non-positively connected to each other, namely, by an intermeshing of the connection means and a mutual bracing. Such a connection is reversible and may be readily released again counter to the direction of bracing.

As was already explained above, the functional unit to be connected to the drive may be an impeller, preferably, an axial, radial or diagonal impeller. In any case, this impeller is to be connected to a drive element on the output side so that the impeller can produce the air flow.

The functional unit may also be a functional unit which influences the air current, for example, a front guidance grid, a post-guidance impeller, and/or a diffuser, etc. These functional units are to be viewed as supplements to the precautionary measures of the impeller, wherein the teaching of the disclosure also refers to the mere precautionary measures for such influencing functional units which are namely associated by the bracing of connection means directly or indirectly to the drive, the housing of the drive or to a holding/fastening device associated with the drive.

The functional units, regardless of what structural type and function, may be directly connected to the drive or to a structural component of the drive. It is also conceivable that the particular functional unit is connected by an adapter flange to the drive or to a structural component of the drive. The adapter flange for its part, may be associated with the drive or the housing or a structural component of the drive or, however, also with the particular functional unit, for example, it may be permanently or detachably connected to the latter.

The connection means advantageously comprises engagement elements and engagement openings serving for the insertion of the engagement elements, wherein the engagement elements and the engagement openings are coordinated with each other. They cooperate in pairs.

Concretely speaking, the engagement elements may be associated with the drive or the adapter flange or the functional unit. Accordingly, the engagement openings would then be associated with the particular other structural component, i.e., the functional unit or the adapter flange or the drive. During the assembly of the drive and of the functional unit(s) the engagement elements and the engagement openings are coordinated with each other and mutually engage.

The engagement elements may be designed in the sense of an engagement bolt and have a thinner engagement neck and a thicker engagement head serving for engaging behind. In the framework of such a design the engagement elements are constructed, for example, like a mushroom.

The insertion openings have a larger insertion area for inserting and inserting the insertion head through and have a narrower shifting area for shifting the insertion neck when the insertion head has been completely inserted. This means that for the mutual connection of the drive and the functional unit, all insertion heads of the engagement elements are inserted into the particular insertion areas of the insertion openings, and after the insertion heads have been completely inserted through, the engagement elements with the thinner insertion necks are shifted along the narrower shifting areas, as a result of which a first positive shifting and locking takes place.

For the bracing, the surface of the shifting area, which surface faces the insertion head, is advantageously formed in a direction away from the insertion area so that it forms a ramp in such a manner that during the shifting of the inserted insertion head along the shifting area a mutual bracing of the connection means takes place. During the bracing the insertion head serves opposite the end of the insertion neck, which end is turned toward the insertion head, as a support so that a bracing of the connection means takes place along the ramp-like shifting area.

Several pairs of engagement elements and engagement openings are formed along the circumference of the drive or of the adapter flange or of the functional units which pairs are coordinated with each other in their position and their design. This creates a secure connection by several pairs of connection means by the mutual bracing of the connection means.

It is also conceivable that the connection means, i.e., the engagement elements and engagement openings, is not, for example, totally associated with the drive and the particular functional unit on the one side or the other side but rather an alternating association is provided to the drive and to the structural component to be connected to the drive. A mutual association of engagement element and engagement opening is conceivable. It is also conceivable to provide positioning aids, for example by a conical design of the insertion head and/or by the corresponding conical design of the insertion opening.

It is noted at this point that the parts to be connected—drive and one or more functional units—may be connected by an intermeshing and mutual bracing of the connection means, reversibly to the extent possible. Such a connection may also be made, for example, by a bayonet connection, namely with connection means which forms such a bayonet connection even if deviating from the previously discussed embodiments.

Furthermore, it is advantageous if a constructive precautionary measure is made between the connection means and which prevents an unintended loosening of the connection means. This may be achieved by a precautionary measure of preferably self-clamping catch means which counteracts an undesired loosening of the braced connection means. Such catch means may comprise catch grooves and catch tongues or catch noses which act during the insertion of the engagement elements into the engagement openings. Such catch means may be designed similarly to the catch means of cable connectors, wherein it is conceivable to provide a tilting lever for loosening the catch connection, which lever acts on the catch tongue or catch nose so that it may be brought out of engagement with the catch grooves.

The method according to the disclosure solves the initially cited task with the features of the claims, according to which the previously cited ventilator with the claimed technical features can be readily mounted, wherein the particular functional unit is associated with the drive or the structural component of the drive of with an adapter flange directly or indirectly in a positive or non-positive manner by intermeshing and a mutual bracing of connection means.

Figure 3:
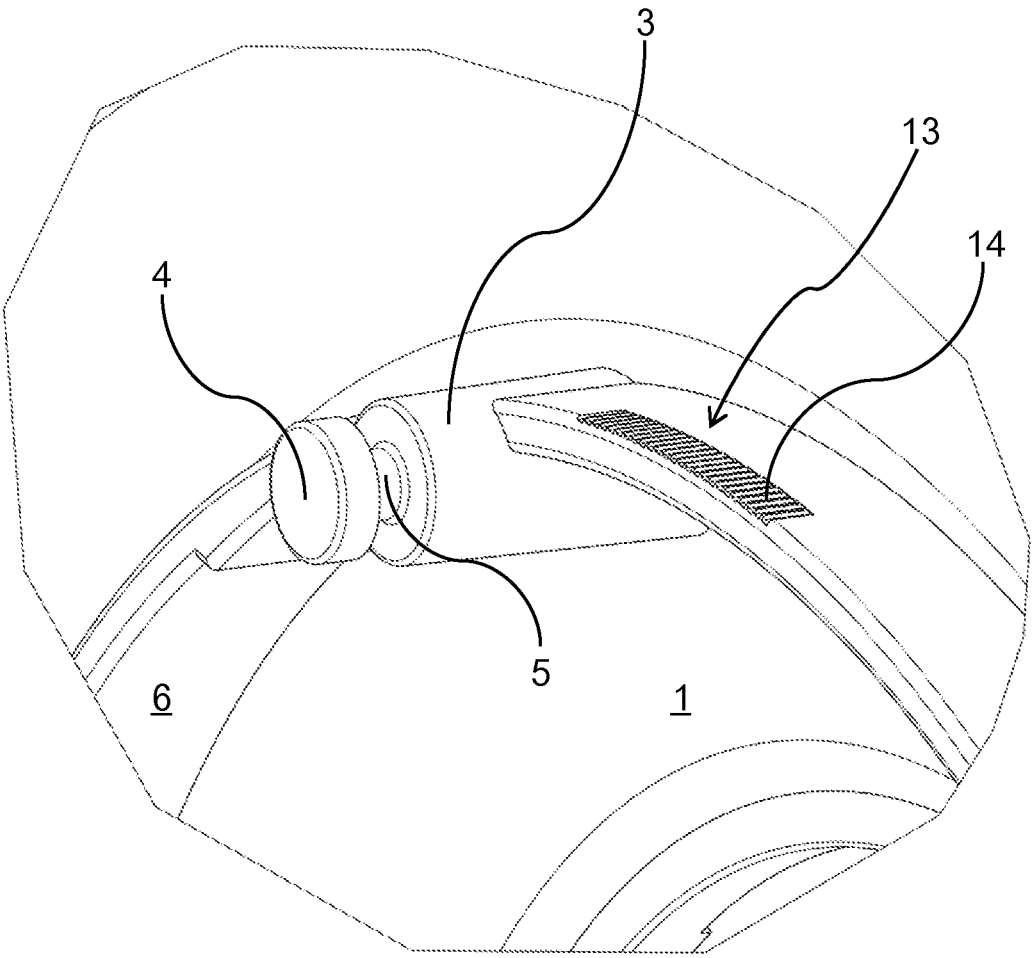
Figure 4:
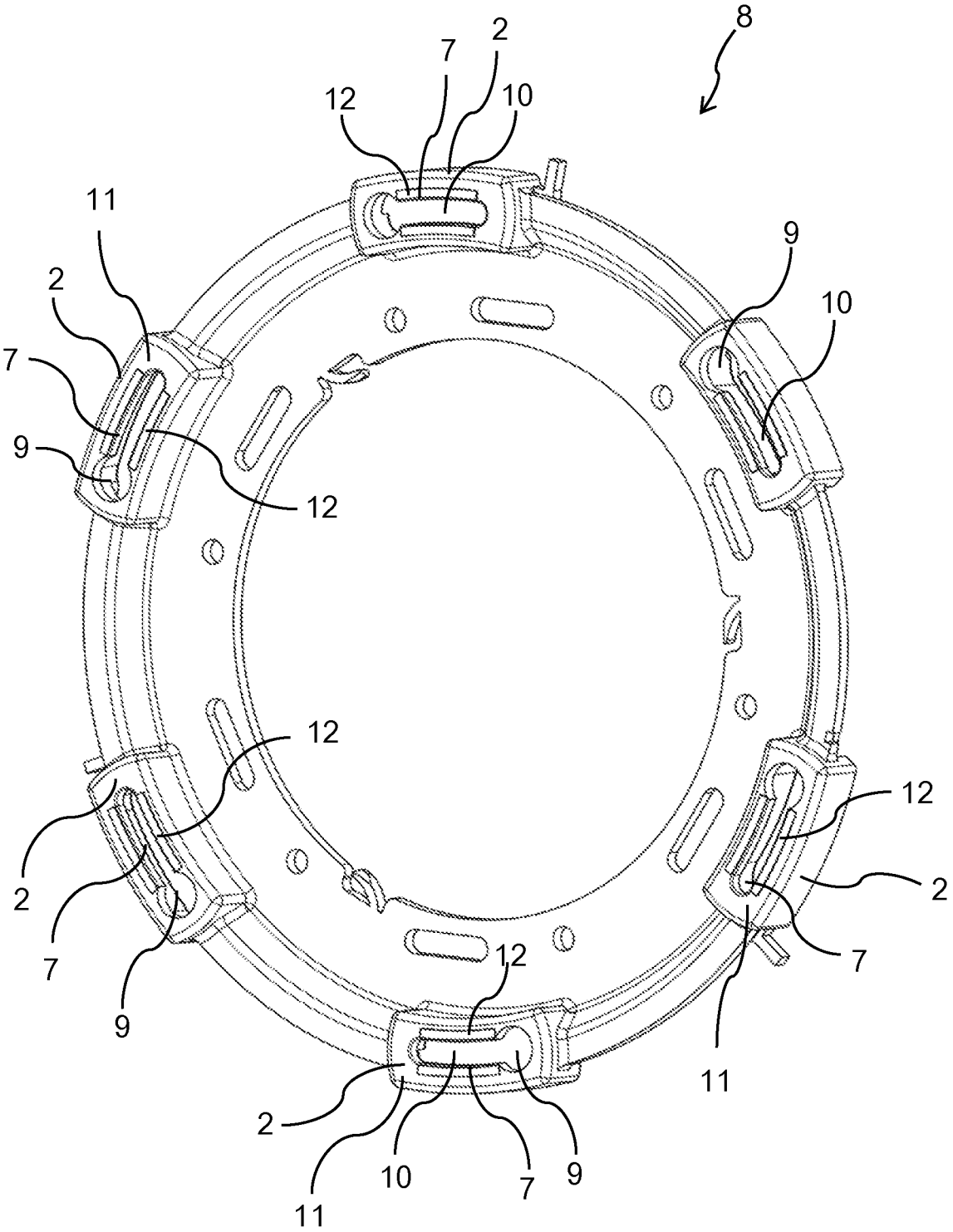
Figure 5:
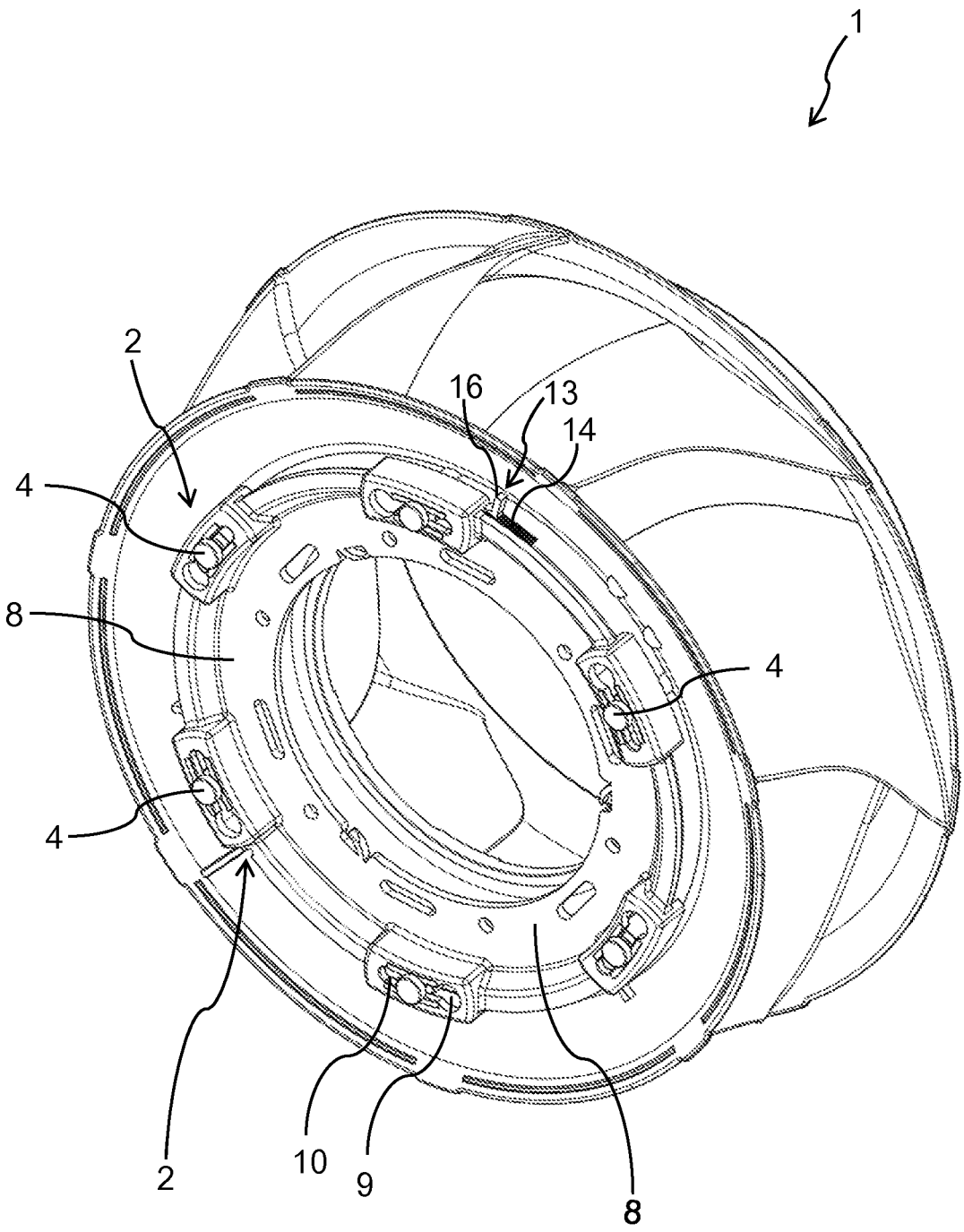
Figure 6:
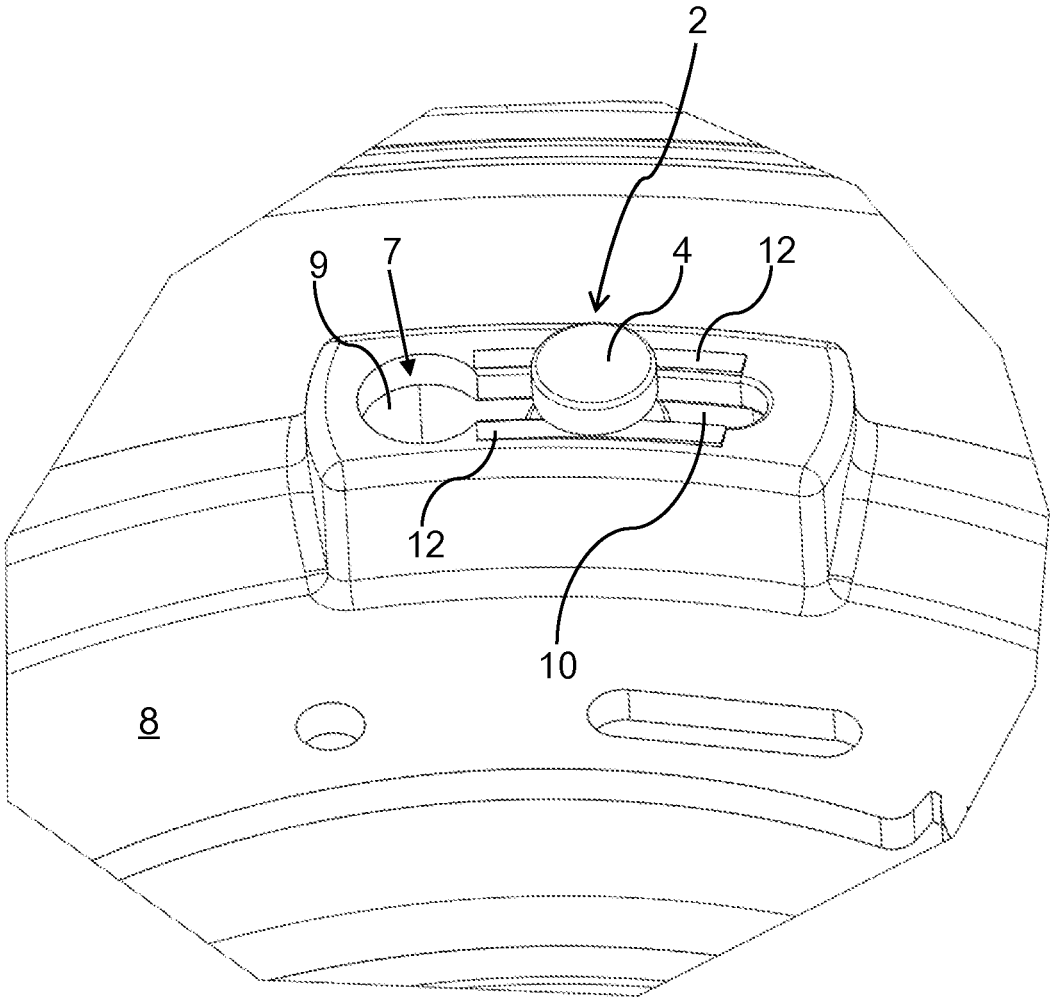
Figure 7:
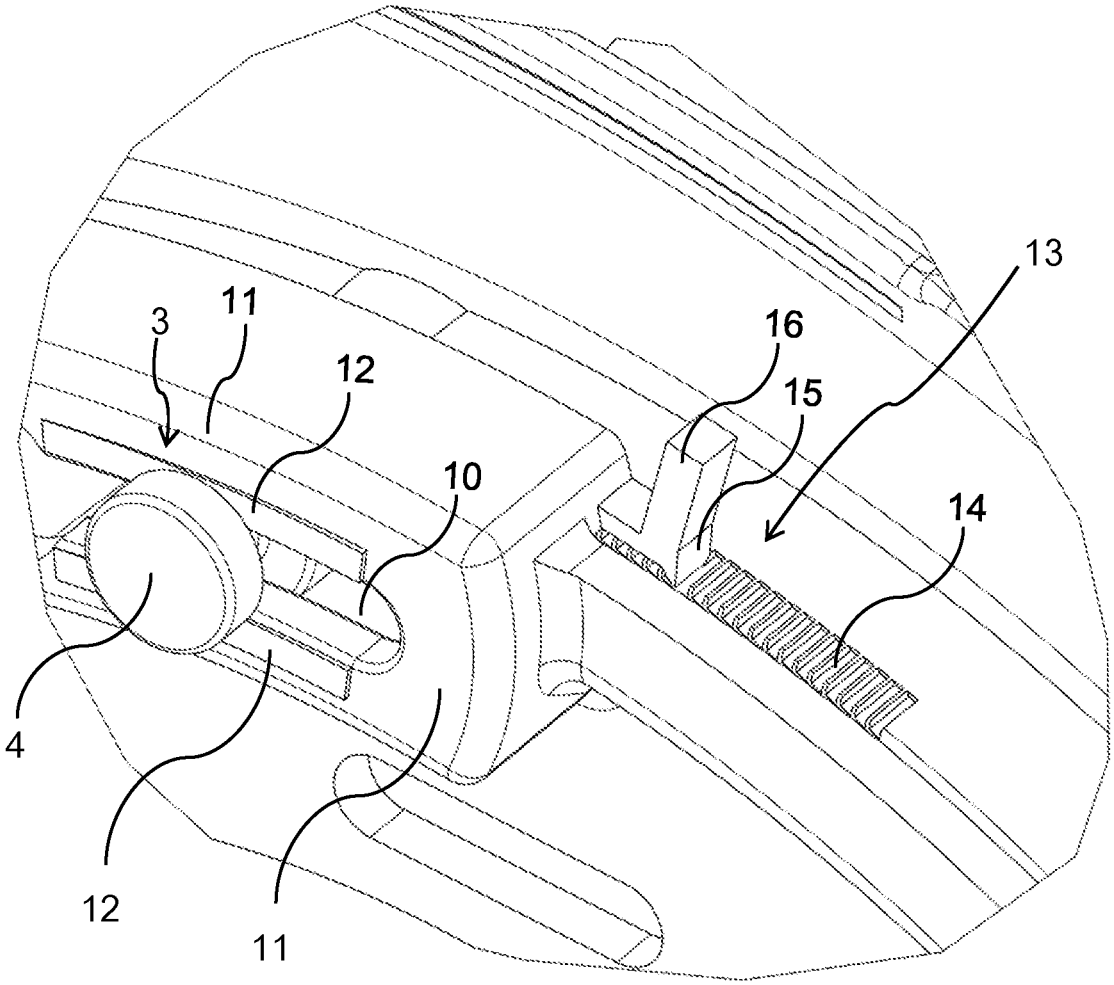
Figure 8:
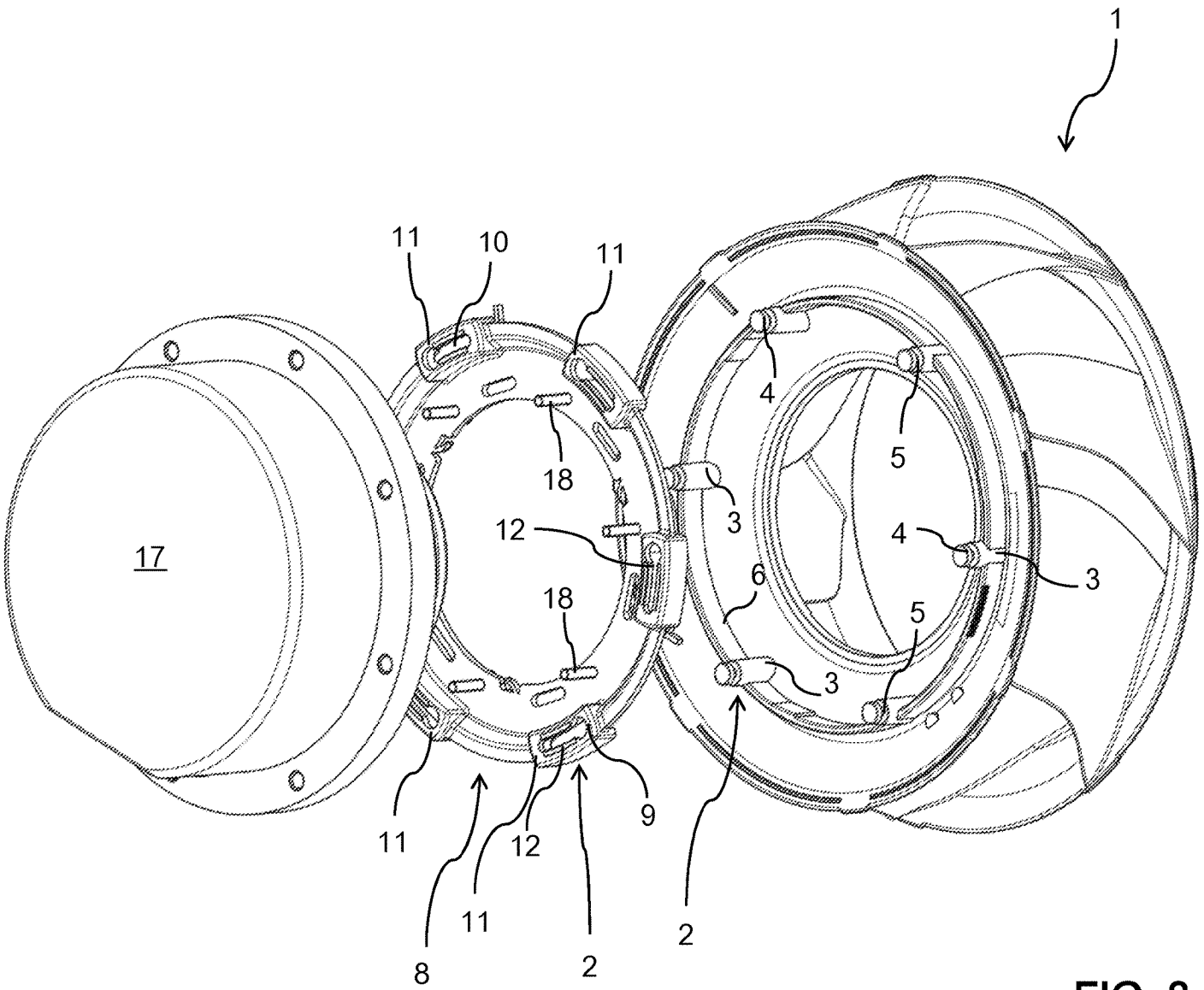

There are various possibilities of designing and further developing the teaching of the present disclosure in an advantageous manner. Refer to this end, on the one hand to the claims dependent on claim 1 and on the other hand to the following explanation of a preferred exemplary embodiment of the disclosure using the drawings. Embodiments and further developments of the teaching which are generally preferred are also explained in conjunction with the explanation of the preferred exemplary embodiment of the disclosure using the drawings. In the drawings FIG. 1 shows a schematic view of an impeller for a ventilator with connection means directly attached/formed on it, FIG. 2 shows the subject matter of FIG. 1 in another view, FIG. 3 shows a detailed view of a connection means constructed as engagement element and which is formed according to FIGS. 1 and 2 on the impeller, FIG. 4 shows a schematic view of an adapter flange with connection means formed on it in which cooperates with the connection means of the impeller according to FIGS. 1 and 2, wherein the adapter flange may be connected to the drive of a ventilator, FIG. 5 shows a schematic view of the impeller of FIGS. 1 and 2, wherein the connection means of the impeller and of the adapter flange engage in one another and are braced against one another, FIG. 6 shows an enlarged detailed view of the engagement of the engagement element into an engagement opening associated with the adapter flange, FIG. 7 shows an enlarged detailed view of the subject matter of FIG. 6, wherein self-clamping catch means are provided for an undesired loosening of the braced connection means, and FIG. 8 schematically shows an exploded view of components of the ventilator according to the disclosure with an impeller and an adapter flange provided between the impeller and the electrical drive as well as with the electrical drive itself.

It is noted at first as regards the figures and the following description of the figures that only those structural components are described and provided with reference numerals here which have a relationship with the teaching according to the disclosure. For the sake of a simple presentation, the presenting and explaining of other features concerning the ventilator are not made.

FIG. 1 shows an impeller 1 as a component of a ventilator according to the disclosure. This impeller 1 is to be connected on the output side to a drive unit which is not shown. In order that this connection can take place without screws, special connection means or connectors 2 are provided there which is designed as engagement elements 3. The engagement elements 3 have a button-like/mushroom-like an inserting head 4 and a thinner insertion neck 5. The engagement elements 3 are arranged in a circle and fastened on an integral annular flange 6.

Figure 2:
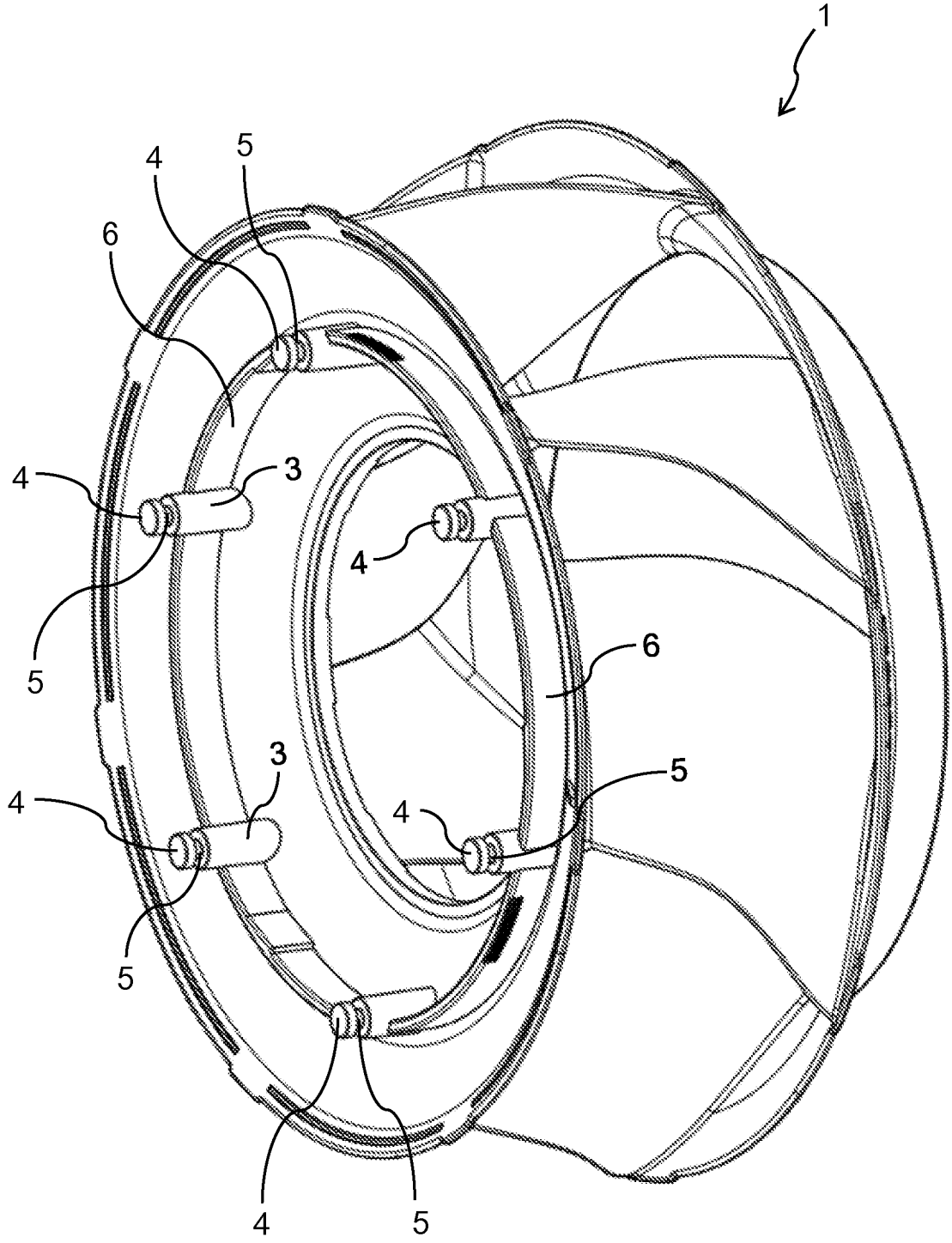

FIG. 2 shows the previously discussed features on account of the somewhat different view in detail, in particular as regards the design of the insertion elements 3 with insertion head 4 and insertion neck 5.

The insertion elements 3 of the impeller 1 shown in the FIGS. 1 and 2 correspond to engagement openings 7 which may be directly associated on the output side with a connection area of an adapter flange which is not shown.

FIG. 3 shows in detail the annular flange 6 of the impeller 1 according to FIGS. 1 and 2, wherein catch means or catch 13 in the form of catch grooves 14 are provided outside on the annular flange 6 in the direct vicinity of the insertion element 3.

FIG. 4 shows an adapter flange 8 which is connected in intermediately and is directly fixed on the motor in a rotating or driven manner. This adapter flange 8 is provided according to the arrangement of the engagement elements 3 according to FIGS. 1 and 2 with special connection means 2, namely, with engagement openings 7 which serve for the insertion of the engagement elements 3.

Concretely speaking, the engagement openings 7 are provided with a rather large insertion area 9 for inserting the insertion head 4 and inserting it through, wherein the insertion head 4 is inserted so far into the insertion area 9 until the insertion element 3 can be shifted along a narrower shifting area 10 into a stopping position.

A bracing of the intercommunicating connecting means 2 is achieved in that the support surfaces 11 for the insertion head 4 are constructed like a ramp, namely, with rising ramp surfaces 12 so that during the further inserting or inserting through of the insertion element 3, a bracing takes place in the area of the insertion head 4 opposite the engagement opening 7.

It is noted at this position that the precautionary measurement of the previously discussed adapter flange 8 is not necessarily required but rather the connection means 2—insertion opening 7 with insertion area 9 and shifting area 10—can be directly associated with the drive.

FIG. 5 shows the impeller 1 according to FIGS. 1 and 2 on which the adapter flange 8 is fastened according to FIG. 4 and is firmly connected by the intermeshing and mutual bracing of the connection means 2. It is already indicated in the view in the FIGS. 1, 2 and 3 that catch means 13 are provided with catch grooves 14 and a catch tongue 15 with a small lever 16 for loosening the self-clamping effect.

FIG. 6 shows the mutual engagement of the connection means 2, wherein the insertion head 4 is brought along the narrow shifting range 10 along the ramp surface 12 into the clamping and arresting position.

FIG. 7 also shows the engagement of the clamping means 2, wherein the previously already discussed catch means 13 are provided with catch grooves 14, catch tongue 15 and a lever 16 serving for loosening.

FIG. 8 shows components of the ventilator according to the disclosure in an exploded view. The electrical drive 17, which is not shown in FIGS. 1 to 7, is indicated. An adapter flange 8 is provided for the connection of the impeller 1 to the drive 17, which flange is screwed to the drive 17.

The adapter flange 8 is provided with a device for protection against rotation, for example, with positioning pins 18 or screws for the non-rotating positioning on the drive 17. Parts of the connection means 2 are provided on the adapter flange 8 along the circumference, namely, engagement openings with a larger insertion range 9 and a narrower shifting range 10. The ramp-like support surface 11 and the ramp surface 12 are indicated.

Complementary connection means 2 is provided on the impeller 1 along an annular flange 6. This connection means 2 comprises engagement elements 3 with insertion head 4 and insertion neck 5.

Otherwise, in order to avoid repetitions, reference is made to the general part of the specification.

As regards other advantageous embodiments of the disclosure, in order to avoid repetitions, reference is made to the general part of the specification and to the attached claims.

Finally, it is expressly pointed out that the previously described exemplary embodiment of the disclosure serves only to explain and does not limit the exemplary embodiment.

LIST OF REFERENCE NUMERALS

1 impeller
2 connection means
3 engagement element (connection means)
4 insertion head of the engagement element
5 insertion neck of the engagement element
6 annular flange of the impeller
7 engagement opening (connection means)
8 adapter flange
9 larger inserting area (of the engagement opening)
10 narrower shifting range (of the engagement opening)
11 support surface (on the side of the engagement opening)
12 ramp surface
13 catch means
14 catch grooves
15 catch tongue
16 lever (for loosening the catch tongue)
17 drive
18 positioning pins, screws

The invention claimed is:

1. A ventilator, comprising:

an electrical motor having a stationary element and a rotating element, the rotating element configured to rotate around an axial direction;

at least one rotating or non-rotating functional device respectively connected to the rotating element of the electrical motor or to the stationary element of the electrical motor, wherein the at least one rotating or non-rotating functional device is configured to respectively generate or influence an air current, and wherein the at least one rotating or non-rotating functional device is positioned coaxially around the electrical motor, on a first side of the ventilator, or on a second side of the ventilator, wherein the ventilator is configured to generate an air current from the first side to the second side of the ventilator; and a connector that connects the at least one rotating or non-rotating functional device respectively to the rotating element of the electrical motor or to the stationary element of the electrical motor, the connector comprising:

a first connector component; and a second connector component, wherein one of the first and second connector components is connected to the at least one rotating or non-rotating functional device, and the other of the first and second connector components is connected to the rotating element of the electrical motor or to the stationary element of the electrical motor, the first and second connector components are configured to mechanically engage to thereby form an intermeshing and mutually bracing mechanical connection, the first and second connector components include a plurality of engagement elements and corresponding engagement openings, the engagement elements include an engagement neck and an engagement head, the engagement neck has a smaller thickness than a thickness of the engagement head, and the engagement openings include:

an insertion area configured to allow insertion of the insertion head; and a shifting area configured to allow a position of the insertion head to be shifted relative to the insertion area after the insertion head has been inserted into the insertion area, the shifting occurring due to the rotation of the first and second connector components relative to one another, the shifting area being narrower than the insertion area so that the engagement neck mechanically engages with the shifting area to form the intermeshing and mutually bracing mechanical connection.

2. The ventilator according to claim 1, wherein the at least one rotating or non-rotating functional device is an axial, radial, or diagonal impeller.

3. The ventilator according to claim 1, wherein the at least one rotating or non-rotating functional device is a front guidance grid, a post-guidance impeller, or a diffuser.

4. The ventilator according to claim 1, further comprising:

an adapter flange connected to the at least one rotating or non-rotating functional device, to the rotating element of the electrical motor, or to the stationary element of the electrical motor, wherein the adapter flange is configured to connect the at least one rotating or non-rotating functional device to the rotating element of the electrical motor or to the stationary element of the electrical motor, the adapter flange being connected to one of the first and second connector components.

5. The ventilator according to claim 4, wherein the adapter flange is connected to the rotating element of the electrical motor or to the stationary element of the electrical motor, and wherein the other of the first and second connector components is connected to the at least one rotating or non-rotating functional device.

6. The ventilator according to claim 4, wherein the adapter flange is connected to the at least one rotating or non-rotating functional device, and wherein the other of the first and second connector components is connected to the rotating element of the electrical motor or to the stationary element of the electrical motor.

7. The ventilator according to claim 1, wherein a surface of the shifting area has an increasing thickness in a direction away from the insertion area so that, during the shifting of the inserted insertion neck along the shifting area, a mutual bracing of the insertion neck and shifting area occurs.

8. The ventilator according to claim 1, wherein the first and second connector components have respective engagement elements and engagement openings formed along respective circumferences of the first and second connector components, wherein the first connector component is connected to a first one of the at least one rotating or non-rotating functional device, an adapter flange, the motor stationary element, and the rotating element of the motor, and wherein the second connector component is connected to a second one of the at least one rotating or non-rotating functional device, the adapter flange, the motor stationary element, and the rotating element of the motor.

9. The ventilator according to claim 1, wherein the first and second connector components each include both engagement elements and engagement openings, the first and second connector components configured such that engagement elements of the first connector component are configured to engage with respective engagement openings of the second connector component and vice versa.

10. The ventilator according to claim 1, wherein the second connector component includes a catch or fastener that is configured to secure the first and second connector components from further rotation, after the first and second connector components have been rotated to form the intermeshing and mutually bracing mechanical connection, the catch or fastener thereby preventing loosening of the mechanical connection.

11. The ventilator according to claim 10, wherein the catch or fastener includes catch grooves, and catch tongues, or catch noses, the catch tongues or catch noses being configured to mechanically engage with the catch groves to thereby prevent rotation of the first and second connector components relative to one another.

12. A method of mounting components of a ventilator, the ventilator including an electrical motor having a stationary element and a rotating element, the method comprising:

connecting a rotating or non-rotating functional device respectively to the rotating element of the electrical motor or to the stationary element of the motor, the rotating or non-rotating functional device configured to respectively generate or influence an air current, wherein connecting further comprises:

engaging a plurality of first threadless male connector components with a plurality of second female connector component to thereby form an intermeshing and mutually bracing mechanical connection between the first and second connector components, wherein one of each of the plurality of first and second connector components is connected to the rotating or non-rotating functional device, and the other of each of the plurality of first and second connector components is connected to the rotating element of the electrical motor or to the stationary element of the electrical motor.

* * * * *